United States Patent [19]

Royce et al.

[11] 4,233,780

[45] Nov. 18, 1980

[54] DOOR SEAL

[75] Inventors: John H. Royce, Woodbridge; John E. Rowarth, Markham; John Walker, Scarborough, all of Canada

[73] Assignee: Her Majesty the Queen in right of Canada, as represented by the Minister of National Defence, Ottawa, Canada

[21] Appl. No.: 10,755

[22] Filed: Feb. 9, 1979

[51] Int. Cl.[3] ..... E06B 7/16

[52] U.S. Cl. ..... 49/485; 49/489; 49/475

[58] Field of Search ..... 49/485, 489, 475; 260/375 B

[56] References Cited

U.S. PATENT DOCUMENTS 3,696,090 10/1972 Lampe ..... 260/375 B

FOREIGN PATENT DOCUMENTS 1555062 8/1970 Fed. Rep. of Germany ..... 49/475

2122951 11/1972 Fed. Rep. of Germany ..... 49/475

*Primary Examiner*—Kenneth Downey

*Attorney, Agent, or Firm*—Murray and Whisenhunt

[57] ABSTRACT

The invention disclosed relates to air-tight seals between a door and a door frame and is particularly applicable to use with vacuum chambers where both the door and door frame are warped to varying degrees due to the stresses caused by high internal pressures. The invention contemplates a gasket assembly which comprises a retaining means including a groove which extends about and adjacent the perimeter of the door frame and a bead of a resilient solid elastomeric material cured in situ. The bead extends somewhat proud of the groove and while in its plastic state the door may be closed against the door frame and the elastomeric material cured in situ, whereby the elastomeric material conforms exactly to the shape of the door to provide an air-tight seal. A sealing composition comprising about 70–80%/w of a resilient solid elastomeric material and about 30–20%/w of an inert thickening agent is also disclosed.

4 Claims, 2 Drawing Figures

DOOR SEAL

Figure 1:
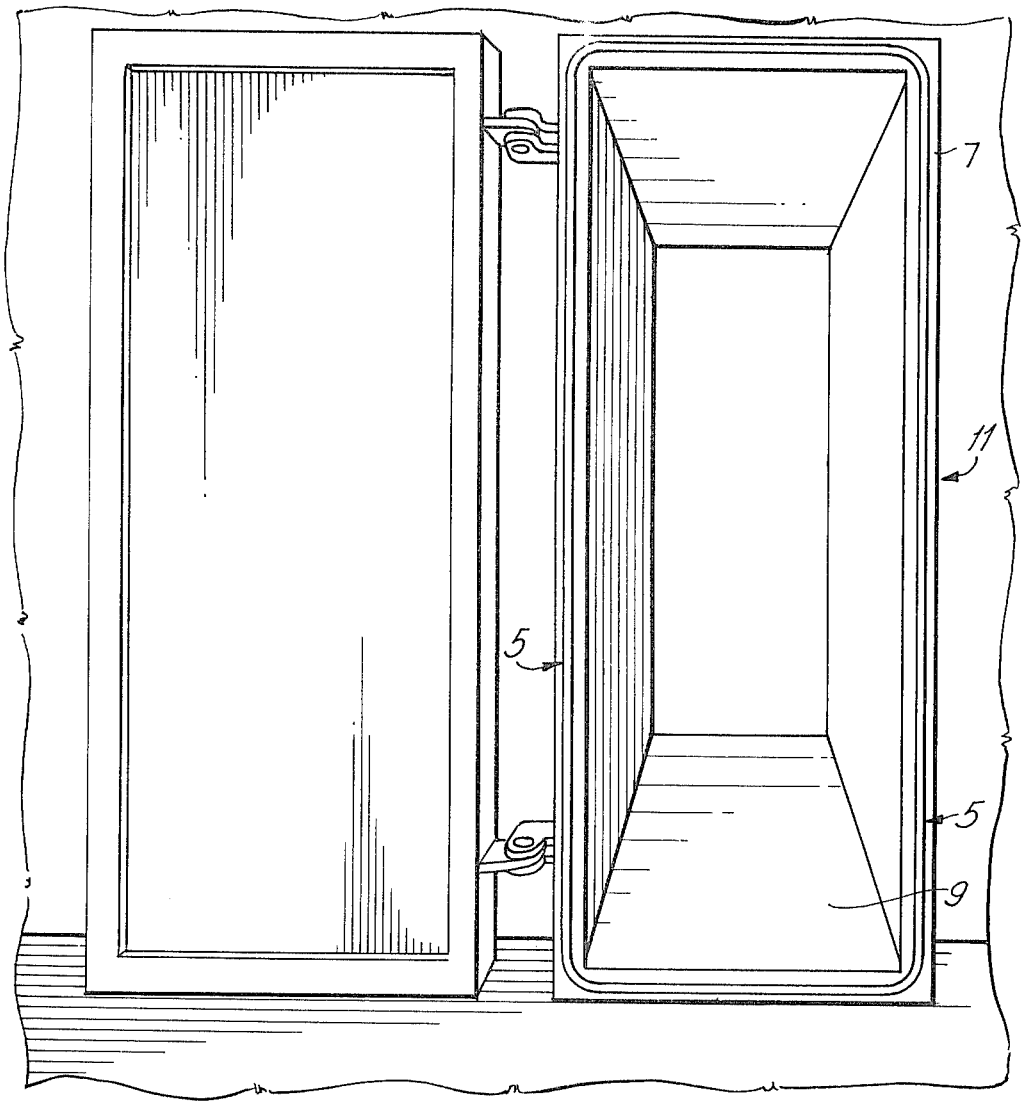

This invention relates to air-tight seals between a door and a door frame, or the like. The seals according to the invention are especially useful when both the door and door frame are warped or twisted to varying degrees. The invention is particularly directed to a novel sealing composition for use in making the seals.

The problem at hand is to find a means for providing an airtight seal around a man-sized door i.e. of dimensions of about 30"×72", in an altitude (vacuum) chamber when the door itself and the door frame are both twisted or warped to varying degrees due to repeated applied stresses over a period of time.

At present, this problem is approached by means of a solid elastomeric gasket e.g. neoprene of Shore hardness of about 70. However, in view of the degree of hardness of this gasket material, the door must bend somewhat to conform to the gasket on the frame in order to seal air-tight.

Currently, there is no means other than deformation of the door caused by a partial vacuum within the chamber which will enable the door to seal air-tight on the gasket. However, sufficient pressure is not available on the outside of the door until the altitude chamber reaches the equivalent of 5,000 feet altitude to cause deformation to occur. The result is a leak between the door and the door frame until an altitude of 5,000 feet is reached within the chamber. The air leak produces somewhat of an unstable reduced pressure condition within the chamber.

It has been suggested to use a softer gasket material. However, this would not eliminate the necessity for the door to twist but would only reduce the amount of twisting required by the door, still precipitating a production of internal stresses within the door. On the other hand, the use of the proposed door sealing system assures that the door configuration and frame configuration are in intimate contact before any pressure comes on, thus substantially eliminating any twisting of the door in an attempt for it to conform to a non-mating surface.

According to the invention, a gasket assembly for providing an air-tight seal between a door and a door-frame, or the like, is contemplated, said assembly comprising a retaining means including a groove extending about and adjacent the perimeter of the door frame, and a bead of a resilient solid elastomeric material cured in situ, said bead being retained in and extending somewhat proud of said groove.

According to another aspect of the invention, a method of making an air-tight seal between a door and a door-frame, or the like, is also contemplated, said method comprising:

a. providing retaining means including a groove about and adjacent the perimeter of the door-frame, b. filling said groove with a bead of an uncured resilient solid elastomeric material, said bead extending somewhat proud of said groove, c. while said elastomeric material is still in its plastic state, closing the door against the door-frame, and d. curing said elastomeric material in situ, whereby said elastomeric material conforms exactly to the shape of the door to provide an air-tight seal.

According to yet another aspect of the invention, a novel sealing composition for use in making said seals is also envisaged, said sealing composition comprising about 70–80%/w of a resilient solid elastomeric material and about 30–20%/w of an inert thickening agent.

Figure 2:
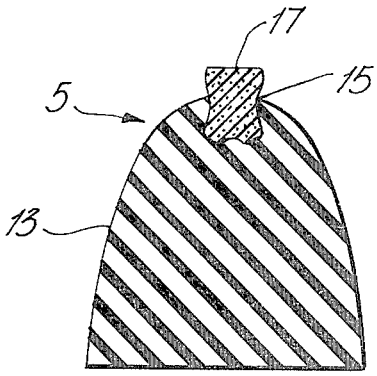

In the drawings which illustrate embodiments of the invention,

FIG. 1 illustrates a door frame including a seal according to the invention, and FIG. 2 illustrates a cross-section of one embodiment of a seal according to the invention.

Referring specifically to the drawings, it will be seen that the preferred form of the seal generally indicated as 5 is attached, conveniently by suitable adhesive means, to the door frame 7, and extends about and adjacent the perimeter of the door opening 9 in a vacuum chamber, shown generally as 11.

From FIG. 2, it will be apparent that the seal 5, comprises retaining means in the form of a strip 13 of solid elastomeric material e.g. a commercially available ogive-shaped neoprene material of Shore hardness of about 70. A longitudinal groove 15 extends the length of strip 13 and a bead 17 of a more resilient solid elastomeric material of Shore hardness of about 30 to 45, is retained in and extends somewhat proud of groove 15.

The longitudinal groove 15 is conveniently cut in the surface of the strip material 13 to about ¼ its width and about ⅛ its depth. The groove 15 is shaped to increase the strength of the bond between the strip of hard elastomeric material 13 and the bead of resilient elastomeric material 17 and to minimize the possibility of the material 17 being accidentally pulled out of the groove. It was found that if the groove was dove-tailed to a certain extent, effective bonding resulted. The useful angle of the dove-tail was found to be about 15° to 40°, with about 30° being preferred. It will be appreciated that the dove-tail configuration is inessential to the invention.

The bead 17 extends somewhat proud of the groove i.e. the surface of the strip material 13 to a sufficient extent to permit an adequate amount of the resilient material to be available for deformation to allow it to conform to the irregular surface of the door to provide an air-tight seal. It will thus be appreciated that the proudness will depend on the particular door and door-frame involved.

The bead 17 is installed while the resilient material is in its plastic state. This permits the self-levelling of the resilient material which allows it to conform to an irregular surface of the door. When cured and upon opening of the door, a perfect mating surface remains on the door-frame, thus enabling an air-tight seal to be maintained between the door and the seal, and hence the door-frame, thus eliminating air leaks. This also eliminates the necessity for a close tolerance machining operation on the door and door-frame, which is virtually impossible on the door-frame since it is part of the huge chamber complex and cannot be successfully machined after fabrication.

In operation, the resilient solid elastomeric material is mixed to a consistency that will enable it to be installed in its plastic state as a bead on a vertical surface without running or sagging (i.e. a thixotropic mix), in a groove cut in the hard solid elastomeric strip material pre-installed on the door-frame.

The groove is pre-cut before installation of the resilient gasket material. A sealing agent, for example, varnish, is coated onto the groove surfaces prior to installation of the resilient elastomeric material to prevent leaching of substances from the existing gasket material into the newly installed resilient gasket material. This is done to prevent contamination of the resilient gasket material which may prevent or delay adequate curing and which may cause the bond between the strip material and the resilient elastomeric material to fail. It will be appreciated that the use of the sealing agent will depend upon the nature of the materials to be bonded.

Using a standard hand-operated caulking gun, a bead of about ¼" wide is laid into the previously routed dovetail groove in the preinstalled neoprene door gasket. Because of its plastic state, the bead will fill the groove and extend somewhat proud of the surface of the gasket. The amount of calking material laid down is unimportant, since any excesses may be cut away after curing.

The surface of the door is sanded to clean and smooth in the area to be contacted by the seal. One light coat of a suitable parting or release agent, for example, silicone, is applied to the sanded area. The need to use such an agent will depend upon the materials of the door and door-frame.

The door is then closed lightly and held in position, for example, by clamps, to permit curing of the resilient elastomeric material in situ. In the case of room-temperature curable elastomers, curing is complete in about 24 hours. The door is then opened and excess cured elastomer may be trimmed off the strip material.

The requirements of the resilient solid elastomeric sealing material may be summarized as follows:

1. Be sufficiently resilient to form an airtight seal on a relatively irregular surface (e.g. tool marked). The Shore hardness of the cured material should be of the order of 30–45.

2. Material to have sufficient tensile strength to enable it to withstand shear forces exerted when a partial vacuum is created within the chamber. The tensile strength should be a minimum of 280 psi.

3. Material to have a memory sufficient to allow it to return to its normal state after deformation a large number of times.

4. Material to be nontoxic and non-degenerative in normal room temperature and normal room atmospheric conditions.

5. Material to be stable enough to remain as installed for several years.

6. Material to be workable, i.e. cuttable with a standard scissors or knife.

7. Uncured material should be sufficiently thixotropic to stand as a self-supporting bead on a vertical surface and yet be thin enough to be extruded through a caulking gun without undue pressure being required.

8. While in its plastic i.e. uncured state the material should be easily deformable, so that when the door is closed lightly against the bead of material there will be a self levelling action to enable the material to conform exactly to the shape of the door. This should form an intimate contact between the door and the door seal in its plastic form and upon curing the seal material should retain its shape, allowing the door to be opened and closed against a perfect mating surface.

It has been found that the aforementioned requirements are satisfied by starting with an uncured elastomeric material, preferably one which is curable or vulcanizable at room temperature, and adding a sufficient amount of an inert thickening agent. By increasing the amount of thickener added, the mix will become too stiff for extrusion from a caulking gun and its tensile strength lower. On the other hand, if the amount of thickener added is too low, the mix would not be sufficiently thixotropic when uncured to stand as a self-supporting vertical bead. However, a thinner mix would have a higher tensile strength upon curing. A compromise must therefore be reached. As seen in table I, it has been found that pure RTV has a tensile strength of about 544 psi, but runs off when extruded as a vertical bead. The useful lower limit of tensile strength is about 280 psi. This is achieved by a mix of about 70%/w RTV and about 30%/w of silicate Table I

| Composition %/w | Tensile Strength psi | Consistency |
|---|---|---|
| 100 RTV ® | 544 | Vertical bead runs off |
| 80 RTV ®/20 "Q" Cell | 328 | suitable |
| 70 RTV ®/30 "Q" Cell | 280 | suitable |

Accordingly sealing compositions comprising about 70–80%/w of a resilient solid elastomeric material and about 20–30%/w of a thickening agent produce effective seals. The thickening agent is preferably a silicate, for example, sodium silicate, in the form of microspheres. A product known as "Q" Cell which is a sodium silicate compound in the form of microspheres manufactured by National Silicates Ltd. is suitable.

The solid resilient elastomeric material is preferably one which is curable or vulcanizable at room temperature. Silicone elastomers, for example, those manufactured under the trademark RTV by General Electric Co. have been found suitable.

It will be appreciated by those skilled in the art that while the invention has been described in conjunction with specific embodiments thereof, it is evident that many alternatives, modifications and variations are possible without departing from the spirit and central characteristics of the invention. Accordingly, it is intended to embrace all such alternatives, modifications and variations which fall within the spirit and scope of the appended claims.

The embodiments of the invention in which an exclusive property or privilege is claimed are defined as follows:

1. A gasket assembly for providing an air-tight seal between a door and a door-frame of a vacuum chamber, or the like, wherein the door and the door-frame are warped to varying degrees due to stresses caused by high internal pressure, said assembly comprising a retaining means including a groove extending about and adjacent the perimeter of the door-frame, and a bead of a resilient solid elastomeric material, said bead being retained in and extending somewhat proud of said groove, said retaining means comprising a strip of a solid elastomeric gasket material of shore hardness of about 70, a longitudinal groove extending the length of said strip material, and said bead of a solid resilient elastomeric material comprising about 70–80%/w of a silicone rubber curable at room temperature and about 30–20%/w of sodium silicate in the form of microspheres, said elastomeric material having a shore hardness of about 30 to 45 and tensile strength of 280 to 328 psi, said strip of solid elastomeric gasket material and said bead cooperating to create an air-tight seal when said door is closed against said door-frame.

2. A gasket assembly according to claim 1, wherein the longitudinal groove is dove-tailed in cross section to an angle of about 15° to 40°.

3. A gasket assembly according to claim 2, wherein the longitudinal groove is dove-tailed in cross section at an angle of about 30°.

4. An air-tight seal between a door and a door frame, said seal comprising a gasket assembly according to claim 1 attached to, extending about and being adjacent the perimeter of the door-frame.

* * * * *